US005498937A

United States Patent [19]

Körber et al.

[11] Patent Number: 5,498,937

[45] Date of Patent: Mar. 12, 1996

[54] ELECTRODELESS HIGH-PRESSURE DISCHARGE LAMP HAVING COIL SUPPORTS OF ALUMINUM NITRIDE SUPPORTING INDIVIDUAL COIL TURNS

[75] Inventors: Achim Körber, Kerkrade; Johannes A. J. M. Van Vliet, Eindhoven, both of Netherlands

[73] Assignee: U.S. Philips Corporation, New York, N.Y.

[21] Appl. No.: 193,971

[22] Filed: Feb. 9, 1994

[30] Foreign Application Priority Data

Feb. 16, 1993 [EP] European Pat. Off. ..... 93200429.4

[51] Int. Cl.[6] ..... H05B 41/16

[52] U.S. Cl. ..... 315/248; 315/243; 315/236; 315/344

[58] Field of Search ..... 315/248, 243, 315/236, 344, 338; 445/67

[56] References Cited

U.S. PATENT DOCUMENTS

| | | | |
|---|---|---|---|
| 843,533 | 2/1907 | Hewitt | 315/248 |
| 4,871,946 | 10/1989 | Witting | 315/248 |
| 4,910,439 | 3/1990 | El-Hamamsy et al. | 315/248 |
| 5,042,139 | 8/1991 | Farrall | 29/602.1 |
| 5,300,860 | 4/1994 | Godyak et al. | 315/248 |
| 5,325,018 | 6/1994 | El-Hamamsy | 315/248 |
| 5,327,049 | 7/1994 | Smolka et al. | 315/248 |

FOREIGN PATENT DOCUMENTS 2217105 10/1989 United Kingdom .

*Primary Examiner*—Robert J. Pascal
*Assistant Examiner*—Reginald A. Ratliff
*Attorney, Agent, or Firm*—Brian J. Wieghaus

[57] ABSTRACT

An electrode-less high pressure discharge lamp has a lamp vessel which is surrounded by an electric coil having turns. End portions of the coil are electrically connected to current conductors. The turns of the coil are supported by aluminium nitride, which is in thermal contact with the current conductors. There is a good heat transfer from the coil to the conductors, keeping the coil relatively cool and efficient. The coil screens the lamp vessel to a small extent only, thereby improving the lamp efficacy.

28 Claims, 3 Drawing Sheets

ELECTRODELESS HIGH-PRESSURE DISCHARGE LAMP HAVING COIL SUPPORTS OF ALUMINUM NITRIDE SUPPORTING INDIVIDUAL COIL TURNS

BACKGROUND OF THE INVENTION

The invention relates to an electrodeless high-pressure discharge lamp comprising:

a light-transmitting lamp vessel which is closed in a vacuum tight manner and which has an ionizable filling;

around the lamp vessel, an electric coil having turns along a plane through the lamp vessel, which coil has end portions which are electrically connected to current conductors which are to be connected to an electric supply.

Such an electrodeless high-pressure discharge lamp is known from U.S. Pat. No. 5,042,139.

The coil of the known lamp is built up from voluminous, for example solid, turns. The result of this is that a comparatively large surface area of the lamp vessel is screened off from its surroundings. Light generated in the lamp vessel as a result cannot freely emerge, which reduces the luminous efficacy of the lamp. This disadvantage also holds for a coil whose upper and lower turns have a conical upper and lower surface, respectively.

It is to be prevented that the coil assumes a comparatively high temperature, and thus a comparatively high electric resistance, owing to current passage and radiation from the lamp vessel. A higher electric resistance would cause the ohmic losses to increase, and as a result also the temperature. To remove heat from the coil, the known coil may have hollow turns through which water is circulated. The screening of generated light, however, is not counteracted by this modification, while the modification has the disadvantage of additional provisions, i.e. the water supply and drain, as well as the energy consumption thereof.

U.S. Pat. No. 4,910,439 discloses an electrodeless high-pressure discharge lamp of the kind mentioned in the opening paragraph in which a forced air current cools the electric coil. Apart from the screening of the lamp vessel, this lamp has the disadvantage that a motor and supply lines are necessary for cooling, and also that energy is required for this.

A disadvantage of a mechanical cooling is, furthermore, that maintenance is required for it and that the life of the cooling drive may be the factor which limits lamp life in the case of a lamp capable of burning a few tens of thousands of hours.

U.S. Pat. No. 4,871,946 discloses an electrodeless high-pressure discharge lamp whose coil is helicoidally wound against the lamp vessel. Here the coil not only intercepts light, but is also strongly heated by the discharge vessel, whereby its resistance increases.

Copper is particularly suitable as a material for the coil because of its high electrical conductivity. Copper has the disadvantage, however, that it readily oxidizes at increased temperature and then turns black. A voluminous coil around the lamp vessel will then not only intercept light, but also absorb it.

GB 2,217,105 discloses an electrodeless high-pressure discharge lamp in which a coil is wound helicoidally around the lamp vessel and has a light-reflecting coating. This only achieves, however, that incident light is partly reflected. Silver, which has a comparatively high reflectivity, however, quickly assumes a dark colour at elevated temperature owing to oxidation. Chromium is comparatively oxidation-resistant, but it has a comparatively low reflectivity. Coatings of these metals, accordingly, are not effective.

SUMMARY OF THE INVENTION

It is an object of the invention to provide an electrodeless high-pressure discharge lamp of the kind described in the opening paragraph which has a comparatively weak light-screening effect and a comparatively low operating temperature.

According to the invention, this object is achieved in that the turns of the coil are supported by aluminium nitride which is accommodated between the current conductors so as to be in thermal contact therewith.

Aluminium nitride combines a comparatively high electrical resistivity of approximately $10^{12}$ Ωm with a comparatively high thermal conductivity, approximately 150 $Wm^{-1}K^{-1}$. This renders it highly suitable for use as a support for the turns of the coil. The aluminium nitride removes heat towards the current conductors without short-circuiting the turns.

The use of aluminium nitride renders it possible to use turns of a comparatively small cross-sectional area transverse to the current path, so that the turns screen off the lamp vessel to a comparatively small degree only. A small screening is possible in addition owing to the high thermal conductivity of aluminium nitride. This means that aluminium nitride of small dimensions can be used, while nevertheless heat can be effectively transferred from the coil to the current conductors and from there to the surroundings.

An advantage of the use of aluminium nitride also is that the path length for the heat transport is smaller than in known coils. In the known coils, the heat transport takes place through conduction through the turns of the coil along the path of the electric current. The greatest path length of the heat transport, accordingly, is half the path of the electric transport through the coil. In the lamp according to the invention, heat is removed through the aluminium nitride from each and every spot of each turn. The greatest path length for the heat transport is half as great as in the known coil already in the case of a coil having two turns. This fraction is much smaller for coils having more turns.

In an embodiment of the electrodeless high-pressure discharge lamp according to the invention, the coil has turns joined into a spiralling shape on a plate-shaped support of aluminium nitride. The turns may be present at a first surface of the support and an end portion of the coil may extend to the relevant current conductor at a second surface, for example, through an opening in said support in which the lamp vessel is accommodated. In a modification, however, the support also has turns joined together into a spiralling shape at a second surface, which turns are connected to those at the first surface.

Turns may be provided by additive techniques such as, for example, silk-screen printing, or by subtractive techniques such as, for example, etching of a pattern into, for example, copperclad aluminium nitride.

In another modification of the embodiment described, turns are enclosed between a first and a second body of aluminium nitride. This modification has the advantage that turns of, for example, copper plating or foil, for example etched, stamped out, or cut from plating or foil, can be held clamped in by aluminium nitride.

In another embodiment, the coil has a layered structure with a layer of aluminium nitride between two adjoining turns each time. The coil may thus have several, for example, six or eight turns in which the conductor has a comparatively large cross-sectional area at a comparatively small height of the layered coil. The aluminium nitride layers may in fact have a thickness of several tenths of a mm up to approximately 1 mm.

It was found that a comparatively low operating temperature and thus a comparatively low electrical resistance of the coil can be realised owing to the good heat transfer from the coil, while the comparatively small thickness of the coil leads to only a small screening of the lamp vessel.

The coil of the lamp according to the invention renders it possible to fasten the lamp vessel thereto, so that an accurate positioning of the lamp vessel relative to the coil is possible. The lamp vessel may have one or several projections which are accommodated in the coil and keep the lamp vessel fixed. A projection may be, for example, a circumferential collar at the lamp vessel, or may have, for example, a T-shape whose crossbar is enclosed in a cavity in the coil, for example in the aluminium nitride thereof. Alternatively, the lamp vessel may have two projections facing away from one another of which at least one has an unround, for example flat cross-section, or two projections positioned close to one another and at an angle to one another. An alternative is a lamp vessel having several projections distributed over a circumference and having, for example, a rod shape. When assembling the coil, it is then possible to accommodate the lamp vessel with its projection(s) in a recess in an aluminium nitride layer.

The electrodeless high-pressure discharge lamp according to the invention renders possible a compact shape in which the use of a cooling fluid, such as air or water, and of circulating means for this purpose is dispensed with. Nevertheless, ohmic losses in the coil are effectively counteracted and the screening of light is effectively reduced.

BRIEF DESCRIPTION OF THE DRAWING

Embodiments of the electrodeless high-pressure discharge lamp according to the invention are shown in the drawing, in which.

DESCRIPTION OF THE PREFERRED EMBODIMENTS

Figure 1:
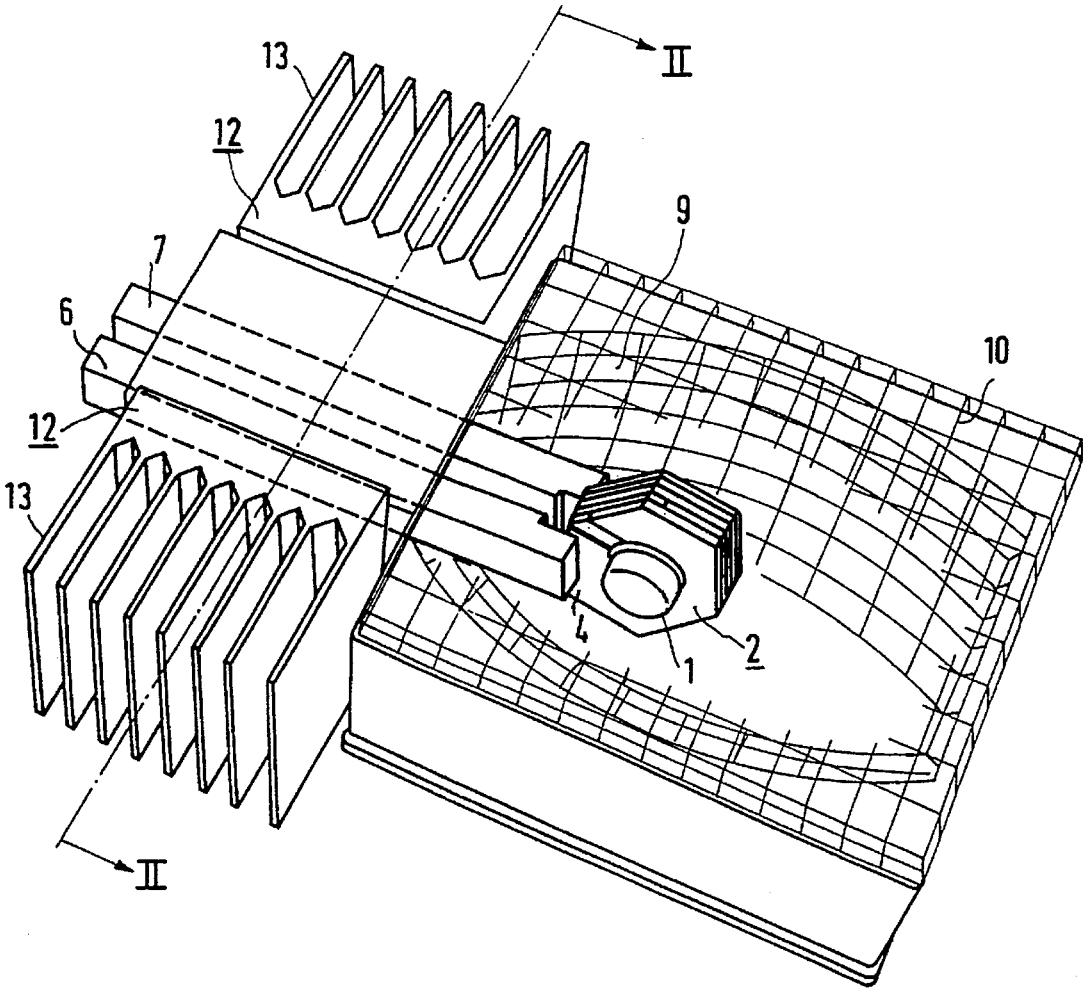
FIG. 1 shows a lamp in perspective view, partly broken away.

In FIG. 1, the electrodeless high-pressure discharge lamp has a light-transmitting lamp vessel 1 which is closed in a vacuumtight manner and which is made of quartz glass in the Figure, having a volume of 2 $cm^3$ with an ionizable filling of 2.5 mg NaI, 1.5 mg $CeI_3$, and 125 mbar Xe. Alternatively, however, the lamp vessel may be made of ceramic material, for example of monocrystalline or polycrystalline ceramic material such as sapphire or sintered aluminium oxide. An electric coil 2 with turns 3 along a plane (S) through the lamp vessel is present around the lamp vessel (see also FIG. 2*a*), which coil has end portions 4, 5 electrically connected to current conductors 6, 7. These conductors, made of copper in the Figure, are to be connected to an electric supply.

The turns 3 of the coil 2 are supported by aluminium nitride 8 which is enclosed between the current conductors 6, 7, in thermal contact therewith.

The lamp vessel 1 is accommodated in a reflector 9 which is closed off with a grid 10 of metal wire. Heat sinks 12 with fins 13 remove heat to the surroundings.

In the following Figures, the same reference numerals are used as in FIG. 1 for corresponding parts.

Figure 2A:
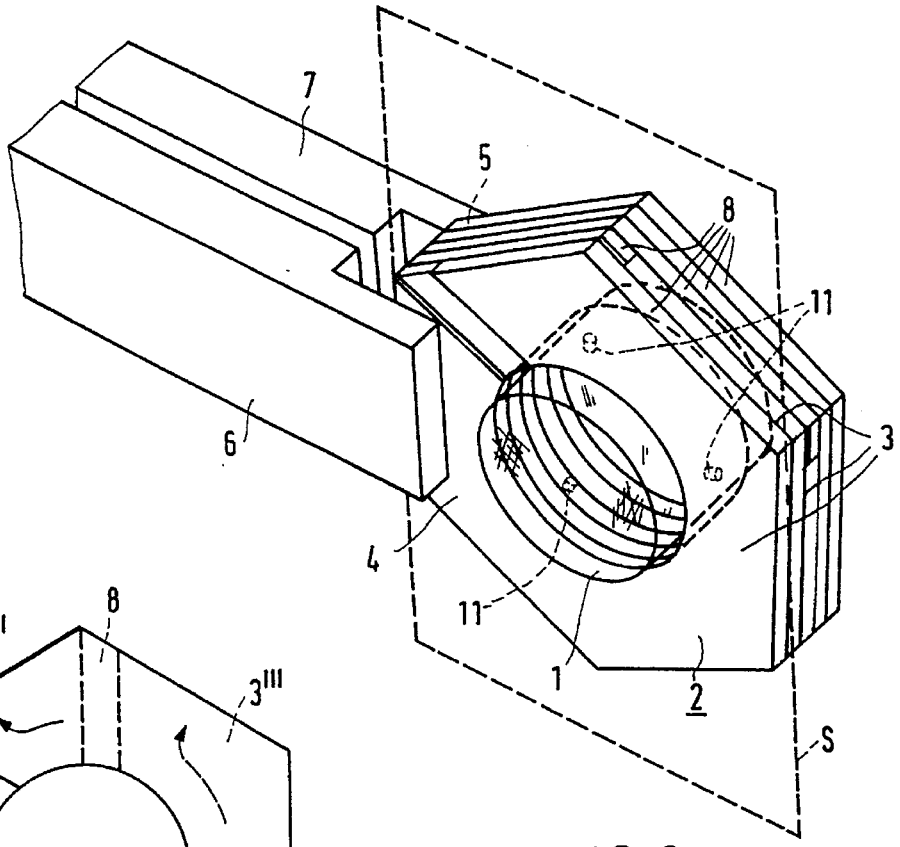
FIG. 2*a* is a detail of FIG. 1.

In FIG. 2*a*, the coil 2 comprises a stack of six turns 3 and five interposed plate-shaped bodies of aluminium nitride 8. Each turn is connected to its preceding and its subsequent turn sideways of the stack, for example, with welds or soldered joints.

Projections 11, three in number in the embodiment shown, are present at the lamp vessel and are enclosed in the coil 2 in order to keep the lamp vessel 1 fixed relative to the coil in this manner.

The coil was realised with copper turns of 0.2 mm thickness and aluminium nitride plates of 0.6 mm thickness. The coil thickness then is 4.2 min. Coils may also be made with different dimensions, however, for example with plates of 0.4 mm and turns of 1 mm, and/or with a greater or smaller number of turns.

Figure 2B:
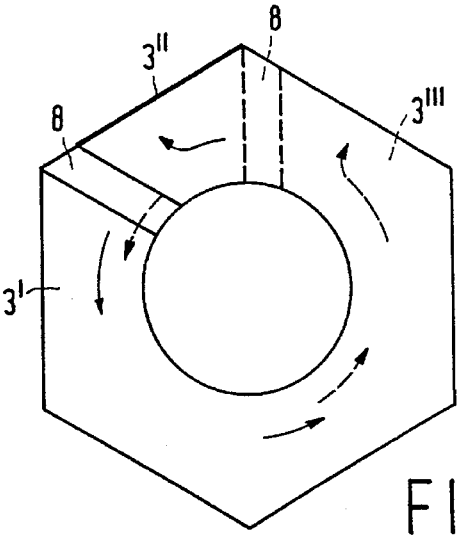
FIG. 2*b* shows an element of a modification of FIG. 2*a;*

In FIG. 2*b*, a plate-shaped body of aluminium nitride 8 has a turn 3' of copper foil at its upper side. Current flows through the turn in the direction of the arrows shown up to the gap in which the aluminium nitride 8 is visible. Through a fold 3" in the foil, the current then continues by the path in the foil at the lower side in the turn 3''' indicated with broken arrows. The elements of FIG. 2*b* are stacked on one another in a coil, seen from top to bottom, rotated through an angle of 60° each time relative to the preceding element in clockwise direction, as are the turns in the coil of FIG. 2*a*.

The lamp of FIGS. 1, 2*a* (Lamp Inv.) was compared with a prior art lamp (Lamp P.A.) having an electric coil of solid copper with three stacked turns in accordance with U.S. Pat. No. 5,042,139. The coil had a conical upper and a conical lower surface. As a result, the coil had a thickness of 18.5 mm at its circumference and a thickness of 9.5 mm in the immediate vicinity of the lamp vessel. The lamps were operated at a frequency of 13.56 MHz.

Data of the lamps after 2000 hours of operation are listed in Table 1.

TABLE 1

| Lamp | $P_{p,c}$ (W) | $\eta_{HF}$ | $T_c$ | $\eta_{HF}*T_c$ | $\eta_{p,c}$ (lm/W) | Φ(klm) |
|---|---|---|---|---|---|---|
| Lamp P.A. | 186 | 0.86 | 0.6 | 0.52 | 87 | 16,2 |
| Lamp Inv. | 186 | 0.78 | 0.8 | 0.62 | 105 | 19,5 |

$P_{p,c}$ power consumed by plasma $P_p$ and coil $P_c$
$\eta_{HF}$ efficiency of supply of high-frequency power = $P_p/P_{p,c}$
$T_c$ transmission of generated light through coil
$\eta_{p,c}$ efficacy of plasma and coil
Φ luminous flux It is evident from Table 1 that the transmission $T_c$ in Lamp Inv., thanks to its small thickness, is much greater than of Lamp P.A. This is of greater importance than the lower $\eta_{HF}$ of the embodiment of the lamp according to the invention. The lower, but comparatively high $\eta_{HF}$ is realised in spite of the small dimensions of the turns, but thanks to the good heat removal from the coil. Owing to the comparatively high $T_c$, the values of $\eta_{p,c}$ and Φ are substantially higher.

Figure 3:
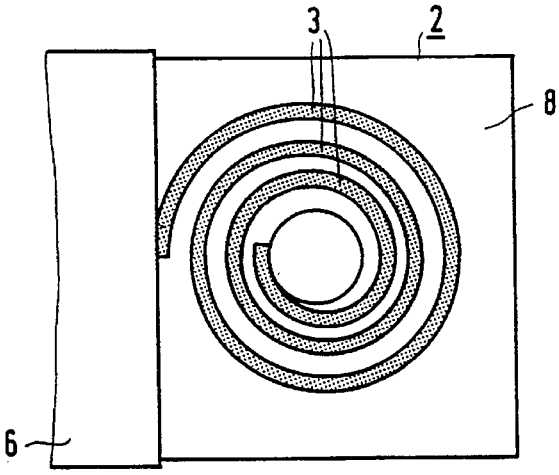
FIG. 3 is an alternative version to FIG. 2*a;*

In FIG. 3, the coil 2 has turns 3 which are joined into a spiralling shape on a plate-shaped body of aluminium nitride 8. From the central opening which is to accommodate the lamp vessel, an end portion of the coil may return at the lower side to the relevant current conductor. Alternatively, turns joined into a spiralling shape may also be present at the lower side.

The turns 3 may be enclosed by means of a second plate-shaped body of aluminium nitride. The turns may be made, for example, from metal foil, or they may be shaped, for example by silk-screen printing, for example from silver.

Figure 4A:
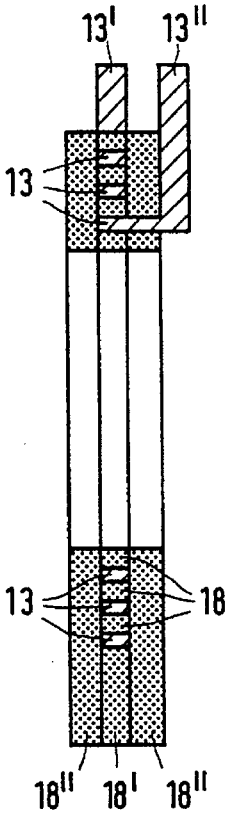
FIG. 4*a* shows a modification of FIG. 3 in cross-section.

In FIG. 4*a*, the turns 13 are formed from copper plating of 1 mm thickness. The turns are I mm wide (see also FIG. 4*c*). The turns have a connection strip 13' for connection to a first current conductor and a conductor 13" for connection to a second current conductor.

Figure 4B:
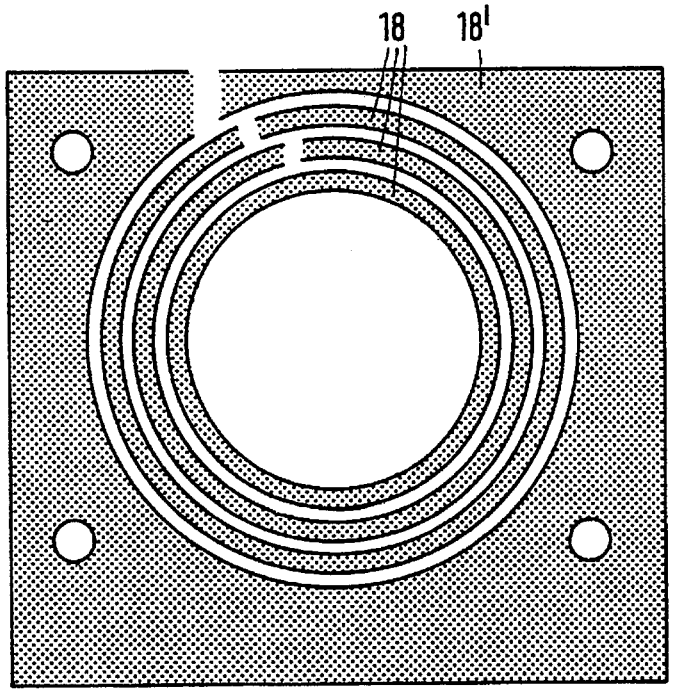
FIG. 4*b* shows the turns of FIG. 4*a* in elevation.

The turns 13 are laterally enclosed between aluminium nitride rings 18 and surrounded by a plate 18' of that same material (FIG. 4*b*).

Figure 4C:
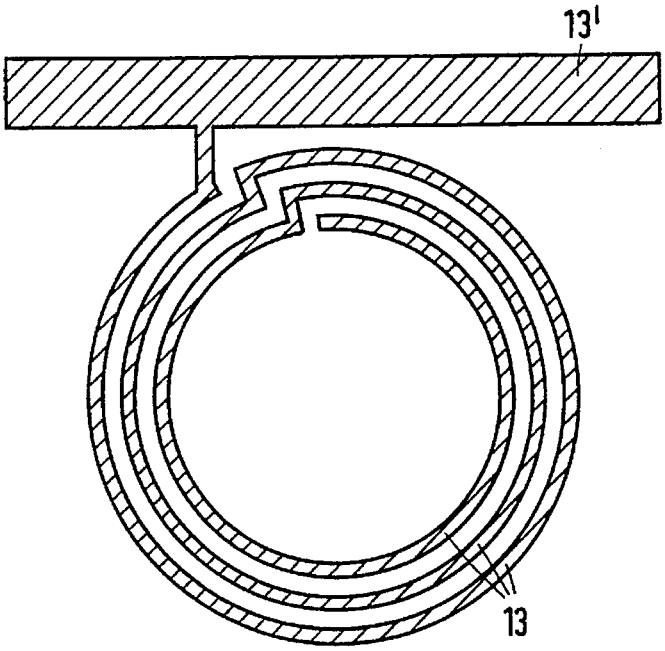
FIG. 4*c* shows the insulation between the turns in elevation.

The assembly of FIGS. 4*b* and 4*c* is shown in FIG. 4*a* as clamped in between two aluminium nitride plates 18", along one of which the conductor 13" extends.

We claim:

1. An electrodeless high-pressure discharge lamp, comprising:

a light-transmitting lamp vessel closed in a vacuum tight manner and having an ionizable filling;

an electric coil disposed around the lamp vessel, and having turns along a plane through the lamp vessel, said coil having end portions;

current conductors electrically connected to said end portions; and a coil support supporting each of said coil turns, said coil support comprising aluminum nitride and being in thermal contact with each of said coil turns.

2. An electrodeless high-pressure discharge lamp as claimed in claim 1, characterized in that said coil support includes a support plate, and turns of said coil are joined into a spiralling shape on said support plate.

3. An electrodeless high-pressure discharge lamp as claimed in claim 1, characterized in that said coil support includes a plurality of support plates, and the electric coil has turns which are joined into a spiralling shape and which are enclosed between respective pairs of support plates.

4. An electrodeless high-pressure discharge lamp as claimed in claim 1, characterized in that the electric coil has a layered structure with a layer of aluminum nitride between each two adjoining turns.

5. An electrodeless high-pressure discharge lamp as claimed in claim 1, characterized in that the lamp vessel has at least one projection enclosed in the coil support for holding the lamp vessel in position.

6. An electrodeless discharge lamp, comprising:

a) a lamp vessel which is energizeable for emitting light;

b) a coil around the lamp vessel for energizing said lamp vessel to emit light, said coil having at least one coil turn; and c) a support plate having an opening through which said lamp vessel extends, said support plate comprising aluminum nitride, supporting said coil turn, and being in thermal contact with said coil turn over substantially the entire length of said coil turn.

7. An electrodeless discharge lamp according to claim 6, wherein said support plate has opposing faces, and said coil includes a coil turn disposed on each face and electrically connected to each other.

8. An electrodeless discharge lamp according to claim 7, wherein said lamp includes a plurality of said support plates arranged in a layered structure, each plate supporting a pair of coil turns, with coil turns on adjacent plates being electrically connected to each other.

9. An electrodeless discharge lamp according to claim 8, wherein said plates have a plate thickness, and said coil turns have a thickness which is substantially less than said plate thickness.

10. An electrodeless discharge lamp according to claim 9, wherein said coil turns comprise a metal foil fixed on said plates.

11. An electrodeless discharge lamp according to claim 9, wherein said coil turns are printed on said plates.

12. An electrodeless discharge lamp according to claim 7, wherein said plates have a plate thickness, and said coil turns have a thickness which is substantially less than said plate thickness.

13. An electrodeless discharge lamp according to claim 12, wherein said coil turns comprise a metal foil fixed on said plates.

14. An electrodeless discharge lamp according to claim 12, wherein said coil turns are printed on said plates.

15. An electrodeless discharge lamp according to claim 6, wherein said plates have a plate thickness, and said coil turns have a thickness which is substantially less than said plate thickness.

16. An electrodeless discharge lamp, comprising:

a) a lamp vessel which is energizeable for emitting light;

b) a coil around the lamp vessel for energizing said lamp vessel to emit light, said coil having at least one coil turn; and c) a support plate having an opening through which said lamp vessel extends, said support plate consisting essentially of aluminum nitride, supporting said coil turn, and being in thermal contact with said coil turn over substantially the entire length of said coil turn.

17. An electrodeless discharge lamp according to claim 16, wherein said coil turn comprises a metal foil fixed on said support plate.

18. An electrodeless discharge lamp according to claim 16, wherein said coil turn is printed on said support plate.

19. An electrodeless discharge lamp, comprising:

a) a lamp vessel which is energizeable for emitting light;

b) a coil around the lamp vessel for energizing said lamp vessel to emit light, said coil having at least one coil turn; and c) a support plate for supporting said coil turn and for transporting heat away from said coil turn, said support plate having an opening through which said lamp vessel extends, and said plate being in thermal contact with said coil turn over substantially the entire length of said coil turn.

20. An electrodeless discharge lamp according to claim 19, wherein said support plate has opposing faces, and said coil includes a coil turn disposed on each face and electrically connected to each other.

21. An electrodeless discharge lamp according to claim 20, wherein said lamp includes a plurality of said support plates arranged in a layered structure, each plate supporting a pair of coil turns, with coil turns on adjacent plates being electrically connected to each other.

22. An electrodeless discharge lamp according to claim 21, wherein said plates have a plate thickness, and said coil turns have a thickness which is substantially less than said plate thickness.

23. An electrodeless discharge lamp according to claim 22, wherein said coil turns comprise a metal foil fixed on said plates.

24. An electrodeless discharge lamp according to claim 22, wherein said coil turns are printed on said plates.

25. An electrodeless discharge lamp according to claim 19, wherein said plates have a plate thickness, and said coil turns have a thickness which is substantially less than said plate thickness.

26. An electrodeless discharge lamp according to claim 25, wherein said coil turns comprise a metal foil fixed on said plates.

27. An electrodeless discharge lamp according to claim 25, wherein said coil turns are printed on said plates.

28. An electrodeless discharge lamp according to claim 19, wherein said plate has opposing plate faces, said coil turn spirals radially outward between said plate faces with successive radially adjacent portions, and said plate includes sections disposed between and supporting said successive radially adjacent portions of said coil turn.

* * * * *